US005562065A

United States Patent [19]

Duarte et al.

[11] Patent Number: 5,562,065

[45] Date of Patent: Oct. 8, 1996

[54] ELASTOMERIC PUMP

[75] Inventors: George M. Duarte, Narragansett; Jeffrey R. Milburn, Providence; Laurent C. Bissonnette, Portsmouth, all of R.I.

[73] Assignee: The United States of America as represented by the Secretary of the Navy, Washington, D.C.

[21] Appl. No.: 514,204

[22] Filed: Aug. 11, 1995

[51] Int. Cl.[6] ..... B63B 1/00

[52] U.S. Cl. ..... 114/238; 114/319; 417/474

[58] Field of Search ..... 114/238, 318, 114/319; 89/1.809, 1.81, 1.816, 1.819; 124/69–73; 42/1.14; 417/474

[56] References Cited

U.S. PATENT DOCUMENTS 4,848,210 7/1989 Bissonnette ..... 114/319

5,200,572 4/1993 Bissonnette et al. ..... 89/1.81

5,410,978 5/1995 Waclawik et al. ..... 114/319

5,438,948 8/1995 Moody ..... 114/238

*Primary Examiner*—Jesus D. Sotelo

*Attorney, Agent, or Firm*—Michael J. McGowan; James M. Kasischke; Prithvi C. Lall

[57] ABSTRACT

There is presented an elastomeric pump including a rigid outer housing defining an outer chamber and having a fluid inlet thereinto. The pump further includes an inner housing disposed within the outer housing. The inner housing is provided with rigid walls and first and second expandable members, the first expandable member having greater elasticity than the second expandable member, the rigid walls and expandable members defining an inner chamber. A fluid conduit extends from the inner chamber to the exterior of the outer housing. A rigid cage is fixed to the inner housing and is disposed over the first expandable member, and is configured to permit and limit expansion of the first expandable member.

11 Claims, 2 Drawing Sheets

ELASTOMERIC PUMP

STATEMENT OF GOVERNMENT INTEREST

The invention described herein may be manufactured and used by or for the Government Of the United States of America for governmental purposes without payment of any royalties thereon or therefor.

CROSS REFERENCE TO RELATED PATENT APPLICATION

The instant application is related to a co-pending U.S. patent application entitled BI-MODAL ELASTOMERIC EJECTOR (Navy Case No. 75892) having the same filing date.

BACKGROUND OF THE INVENTION (1) Field of the Invention

This invention relates to elastomeric impulse energy storage and transfer systems, and is directed more particularly to an elastomeric pump of the type used to eject devices from an underwater vehicle into a surrounding fluid medium.

(2) Description of the Prior Art

Impulse energy storage and transfer systems are known and are used to eject devices, such as torpedoes, from underwater vehicles, such as submarines. In U.S. Pat. No. 4,848,210, issued Jul. 18, 1989 to Laurent C. Bissonnette, there is shown and described an impulse energy storage and transfer system having as a principal component thereof an elastomeric energy storage device. The elastomeric device is adapted to accept and store a working fluid. In accepting the working fluid, the elastomeric means, a bladder-type accumulator, becomes distended. Upon opening of the accumulator for egress of the working fluid, the stored energy is rapidly converted into kinetic energy for quietly ejecting a projectile or other body, along with the stored fluid, from the system and into a surrounding medium, typically seawater. In U.S. Pat. No. 5,200,572, issued Apr. 6, 1993 to Laurent C. Bissonnette, there is shown and described an improved embodiment of elastomeric accumulator.

The U.S. Navy launches devices from submarines using hydraulic impulse pumps of the type shown and described in the Bissonnette patents to obtain the required launch impulse. In most of the systems used, provisions are made to launch devices at a selected one of two exit velocities. Accordingly, two launch pump energy levels are required. The use of a single elastomeric member as a launch pump requires that the two velocities be achieved by incurring different levels of friction loss between the pump and the launch tube. Such is obtained by choking the flow to achieve the lower of the two exit velocities. However, choking has been found to be undesirable because of the complexity of the choking valve system, the loss of efficiency in use of a high-velocity firing for a low-velocity launch, and cavitation problems. An alternative solution is to provide two separate pumps, but such arrangements require two launch valves and two impulse tanks, with consequent cost escalations.

There is thus a need for an impulse pump having the capability of effecting launches at two or more exit velocities, without flow choking means and without additional launch valves and impulse tanks.

SUMMARY OF THE INVENTION

It is, therefore, an object of the invention to provide an elastomeric pump having facility for providing two or more impulse energy levels to effect launches at two or more exit velocities.

With the above and other objects in view, as will hereinafter appear, a feature of the present invention is the provision of an elastomeric pump comprising a rigid outer housing defining an outer chamber and having a fluid inlet thereinto. The pump further includes an inner housing disposed within the outer housing and having rigid wall means and first and second expandable members, the first expandable member having greater elasticity than the second expandable member, the rigid wall means and the expandable members defining an inner chamber. A fluid conduit extends from the inner chamber to the exterior of the outer housing. A rigid cage is fixed to the inner housing, is disposed over the first expandable member, and is configured to permit and limit expansion of the first expandable member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawing in which is shown an illustrative embodiment of the invention, from which its novel features and advantages will be apparent.

In the drawing.

DESCRIPTION OF THE PREFERRED EMBODIMENT

Figure 1:
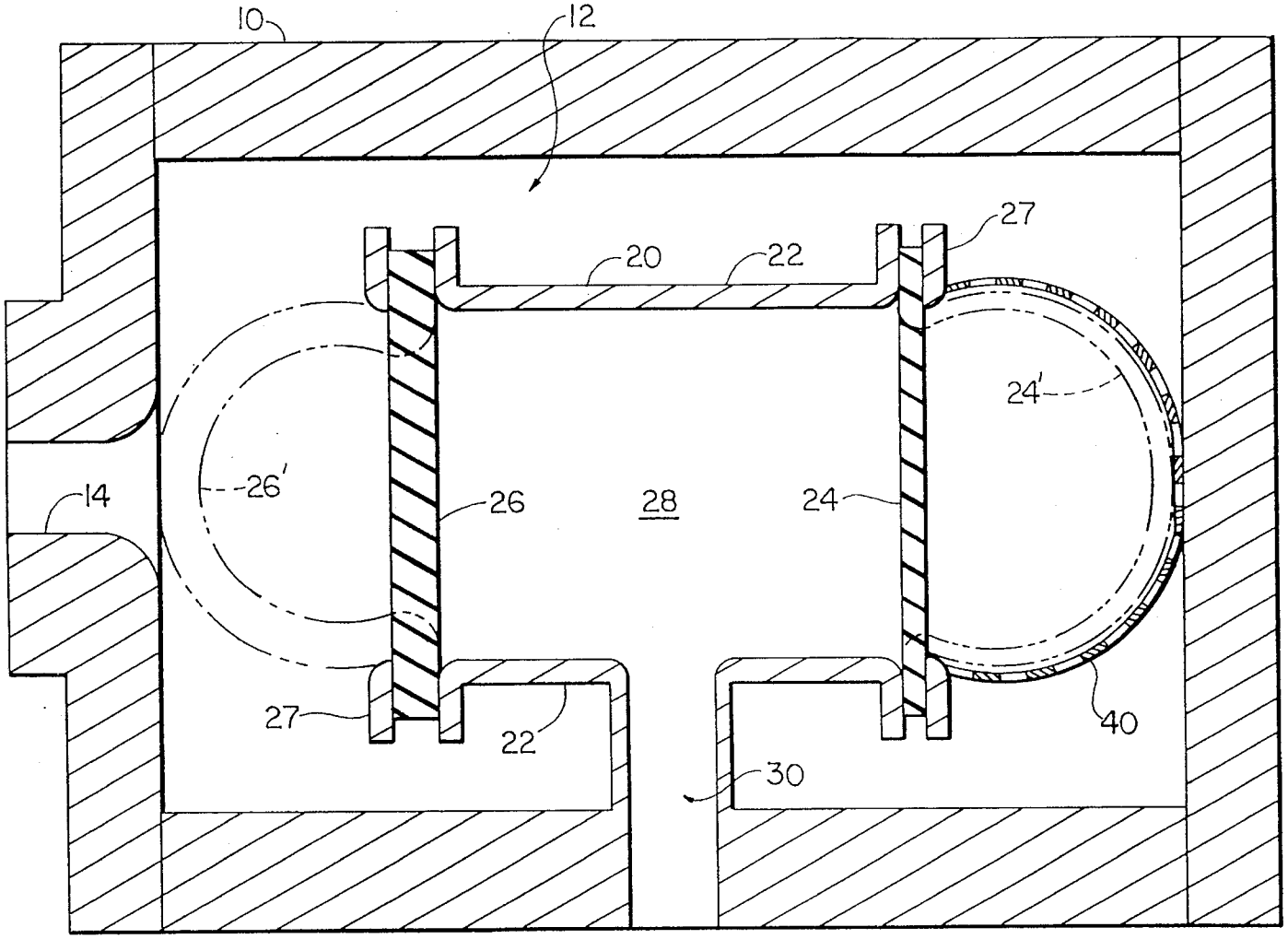
FIG. 1 is a sectional diagrammatic view of an elastomeric pump illustrative of an embodiment of the invention.

Referring to FIG. 1, it will be seen that the illustrative elastomeric pump includes a rigid outer housing 10, preferably of corrosion-resistant metal, defining an outer chamber 12 and having a fluid inlet 14 thereinto, the fluid inlet typically being in communication with a seawater reservoir or medium (not shown).

An inner housing, or impulse tank, 20 is disposed within outer housing 10 and is provided with rigid walls 22, preferably of corrosion-resistant metal, and first and second expandable members 24, 26. The expandable members 24, 26 are in the form of elastomeric walls, as shown in the drawing. The expandable members, as illustrated, comprise, respectively, first and second sheets of elastomeric material, the first sheet 24 being thinner or different in material elasticity than the second sheet 26. The sheets of elastomeric material are secured between rigid walls 22 of impulse tank 20 and a collar member 27. The impulse tank 20 can be of tubular configuration with the members 24, 26 sealing ends of the tube. Alternatively, the expandable members can be in the form of bladder-like members, as shown in the aforementioned Bissonnette patents, anchored on rigid walls (See FIG. 2).

The first expandable member 24 is of greater elasticity than second expandable member 26. The rigid walls 22 and expandable members 24, 26 cooperatively define an inner chamber 28. A fluid conduit 30 extends from inner chamber 28 to the exterior of outer housing 10 and thence to a launch valve (not shown) in communication with a launch tube (not shown).

Fixed to impulse tank 20 is a rigid cage 40 which extends over first expandable member 24. The cage 40 permits expansion of first expandable member 24, shown in expanded condition in phantom in the drawing at 24', but physically limits such expansion. The cage 40 can be of perforated metal construction, or of bar or wire construction. The cage must be strong enough to limit the expansion of first expandable member 24', and sufficiently porous to allow water to flow therethrough into and out of the cage.

In operation, for a low velocity launch, water is channeled through conduit 30 into inner chamber 28 at sufficient pressure to distend first expandable member 24, but not appreciably distend second expandable member 26. The outer chamber 12 is filled with seawater, or the like, providing an inwardly-directed pressure on the expandable members. As first expandable member 24 expands, water within the confines of cage 40 exits through the cage and, in due course, the first expandable member 24 abuts cage 40, which stops further expansion of the first expandable member 24. Upon completion of the impulse tank filling operation, conduit 30 is closed and the pump remains "charged" for a low velocity launch. Upon opening of conduit 30, first expandable member 24 seeks to regain its non-distended condition and forces the water therein into impulse tank 20, and into conduit 30 from which the charged water enters the launch tube to effect launch of a device. As first expandable member 24 deflates, water in outer chamber 12 passes through cage 40 to exercise pressure on the exterior of member 24.

For a relatively high velocity launch, the above charging steps are repeated. After full expansion of first expandable member 24, cage 40 prevents further expansion and possible rupture of the first expandable member 24, while water pressure in impulse tank 20 is further increased to effect expansion of second expandable member 26 to a configuration shown in the drawing in phantom and designated 26'. After completion of charging, conduit 30 is closed and the pump remains "charged" with both expandable members 24, 26 distended. Upon opening of conduit 30, both members 24, 26 expel water into inner chamber 28 and thence into conduit 30 and on to a launch tube (not shown). At this point member 24 allows additional water flow into chamber 28 and 30 so that an abrupt discontinuity of flow does not occur. This prevents a low pressure in chamber 28 and possible separation of the fluid and cavitation.

Figure 2:
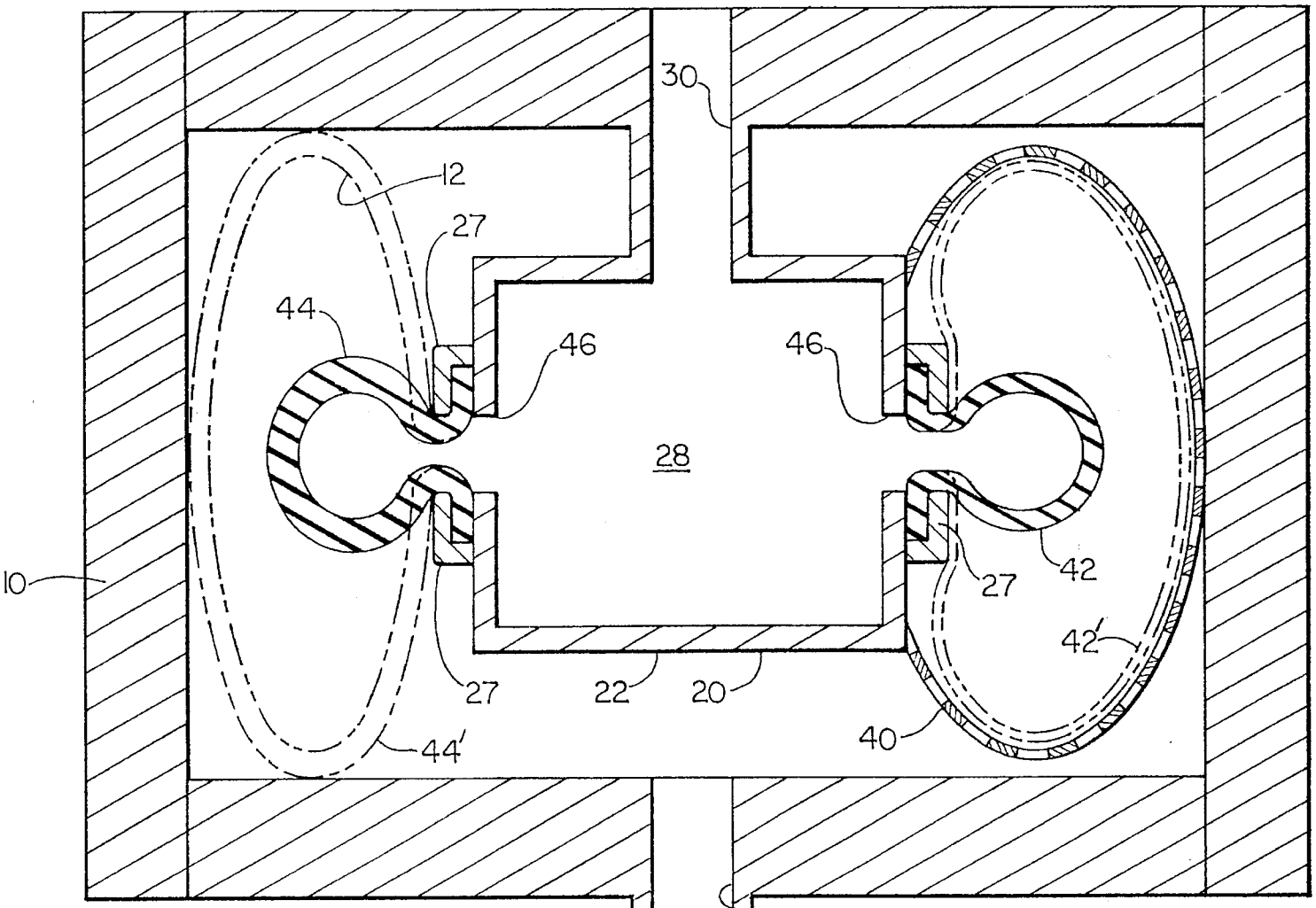
FIG. 2 is a sectional diagrammatic view of an alternative embodiment of the inventive device.

Referring to FIG. 2, there is shown an alternative embodiment of the elastomeric pump of this invention. The alternative embodiment includes a rigid outer housing 10 defining an outer chamber 12 and having fluid inlet 14 into outer chamber 12. An inner housing 20 is disposed within outer housing 10 and is provided with rigid walls 22, a first expandable bladder 42 and a second expandable bladder 44. The first bladder 42 has walls with greater elasticity than that of second bladder 44. This is achieved by providing the first bladder 42 with thinner walls or a more elastic material than second bladder 44. The bladders 42, 44 are secured to rigid walls 22 of impulse tank 20 at an elastomeric member aperture 46 by a collar member 27. The impulse tank 20 can be of tubular configuration with the bladders 42, 44 positioned at the ends of the tube.

The first expandable bladder 42 is of greater elasticity than second expandable bladder 44. The rigid walls 22 and expandable bladders 42, 44 cooperatively define an inner chamber 28. A fluid conduit 30 extends from inner chamber 28 to the exterior of outer housing 10 and thence to a launch valve (not shown) in communication with a launch tube (not shown).

Fixed to impulse tank 20 is a rigid cage 40 which extends over first expandable bladder 42. The cage 40 permits expansion of first expandable bladder 42, shown in expanded condition in phantom in the drawing at 42', but physically limits such expansion. The cage 40 must be strong enough to limit the expansion of first expandable bladder 42', and sufficiently porous to allow water to flow therethrough into and out of the cage 40. The expanded state of the second expandable bladder 44 is shown in phantom at 44'. In operation, the alternative embodiment shown in FIG. 2 is like that of the other embodiment. The first expandable bladder 42 is filled for a low velocity launch, and both bladders 42, 44 are filled for a high velocity launch.

The pump presented herein thus utilizes at least two elastomeric elements having different strain levels for different energy demands required. For the lower energy requirements, the more elastic element does most of the deforming, creating the required pump displacement. For higher energy requirements, the more elastic element deforms to its maximum constrained position and the less elastic element deforms to the required level of strain for the energy needed. The invention thus provides an elastomeric pump which provides two or more impulse levels, without requiring two separate pumps and without the disadvantage of choking systems.

It is to be understood that the present invention is by no means limited to the particular construction herein disclosed and shown in the drawings but also comprises any modification or equivalents within the scope of the claim. For example, though for illustrative purposes there is shown in the drawing a pump having two expandable members, it will be apparent that the pump can be provided with any number of expandable members of different elasticities.

What is claimed is:

1. An elastomeric pump comprising:

a rigid outer housing defining an outer chamber, and having a fluid inlet thereinto, an inner housing disposed within said outer housing and having rigid wall means and first and second expandable members, said first expandable member having greater elasticity than said second expandable member, said rigid wall means and said expandable members defining an inner chamber;

a fluid conduit extending from said inner chamber to the exterior of said outer housing; and a rigid cage fixed to said inner housing rigid wall means and disposed over said first expandable member and configured to permit and limit expansion of said first expandable member.

2. The elastomeric pump in accordance with claim 1 wherein said first and second expandable members comprise, respectively, first and second sheets of elastomeric material forming walls of said inner housing.

3. The elastomeric pump in accordance with claim 2 wherein said first sheet of elastomeric material is thinner than said second sheet of elastomeric material.

4. The elastomeric pump in accordance with claim 1 wherein said cage is perforated to permit fluid to flow therethrough.

5. An elastomeric pump comprising:

a rigid outer housing defining an outer chamber enclosed thereby and having a fluid inlet thereinto;

an inner housing disposed within said outer housing and having rigid wall means, said wall means defining an inner chamber having a fluid conduit aperture and a plurality of expandable member apertures therein;

a plurality of expandable members having at least two different elasticities, each said expandable member being joined to one said inner housing expandable member aperture;

a fluid conduit joined in communication with said inner housing at said conduit aperture and extending from said inner housing to the exterior of said outer housing; and a rigid cage fixed to said inner housing rigid wall means and disposed over at least one said expandable member apertures and configured to permit and limit expansion of those expandable members having a lower elasticity.

6. The elastomeric pump in accordance with claim 5 wherein said plurality of expandable members are made from sheets of elastomeric material.

7. The elastomeric pump in accordance with claim 6 wherein the differing elasticities of said plurality of expandable members are created by providing different thicknesses of elastomeric sheets.

8. The elastomeric pump in accordance with claim 6 wherein the differing elasticities of said plurality of expandable members are created by providing the elastomeric sheets with differing elastomeric compositions.

9. The elastomeric pump in accordance with claim 5 wherein said plurality of expandable members are made from elastomeric bladder structures.

10. The elastomeric pump in accordance with claim 9 wherein the differing elasticities of said plurality of expandable members are created by providing different thicknesses of elastomeric bladder structures.

11. The elastomeric pump in,accordance with claim 9 wherein the differing elasticities of said plurality of expandable members are created by providing the elastomeric bladder structures with differing elastomeric compositions.

* * * * *